US005090656A

United States Patent [19]

Brown

[11] Patent Number: 5,090,656

[45] Date of Patent: Feb. 25, 1992

[54] POST SUPPORT

[76] Inventor: Roger A. Brown, 3423 Gold Candle, Spring, Tex. 77388

[21] Appl. No.: 619,450

[22] Filed: Nov. 29, 1990

Related U.S. Application Data

[63] Continuation-in-part of Ser. No. 482,911, Feb. 22, 1990, abandoned, which is a continuation-in-part of Ser. No. 412,350, Sep. 26, 1989, abandoned.

[51] Int. Cl.[5] ..... F16M 13/00

[52] U.S. Cl. ..... 248/545; 248/546; 248/530; 403/283

[58] Field of Search ..... 403/283, 410; 248/544, 248/545, 546, 530, 533, 156; 52/165, 298, 726

[56] References Cited

U.S. PATENT DOCUMENTS 4,235,034 11/1980 Black ..... 248/530 X
4,242,822 1/1981 Black ..... 248/530 X
4,520,985 6/1985 Blumenthal ..... 248/530
4,588,157 5/1986 Mills ..... 403/283 X
4,649,678 3/1987 Lamson ..... 248/530 X
4,874,149 10/1989 Micelli ..... 248/530

*Primary Examiner*—Andrew V. Kundrat
*Attorney, Agent, or Firm*—Richard C. Litman

[57] ABSTRACT

A sign of fence post support includes an upper polygonal section from which depend a plurality of leg members. The upper section defines an inner socket within which a post bottom is placed and includes a plurality of inwardly directed tangs specifically formed to permit slicing into the material of a post bottom being urged into the socket, to provide a secure interlocking of a post to the support device. A pair of diametrically opposed leg members each comprises a pair of side plates of triangular configuration and disposed normal to one another such that during driving of the support into the ground, obstructions in the soil will urge the bottom tips of the leg member in an outward direction, further anchoring the assembly within the ground.

11 Claims, 2 Drawing Sheets

POST SUPPORT

CROSS-REFERENCE TO RELATED APPLICATIONS

This application is a continuation-in-part of U.S. Pat. application Ser. No. 07/482,911 filed Feb. 22, 1990, now abandoned, which is a continuation-in-part of U.S. Pat. application Ser. No. 07/412,350 filed Sept. 26, 1989, now abandoned.

BACKGROUND OF THE INVENTION

The present invention relates generally, to anchor devices and more particularly, to an improved device for mounting fence or sign posts within the ground. With the instant device, ready means are provided whereby a post is simultaneously rigidly interlocked with the anchor as the anchor and joined post are driven into the ground. The resultant driven assembly provides an enhanced anchorage of the post in view of the lateral displacement of lowermost portions of the anchor during the driving thereof into the ground.

DESCRIPTION OF THE PRIOR ART

Fence and sign post support or anchor devices are fairly well recognized and defined in the art. Generally, they incorporate two significant components in order to fix a post in a particular geographic location. One component will be a subsurface portion adapted to be driven into the ground to provide a rigid and immovable locus A second component will be an above ground portion that is designed to accept the bottom most portion of a post. U.S. Pat. No. D-25,283 issued to Musselman discloses a post anchor including a parallelepiped member that is driven into the ground. A cylindriform part attached atop the solid parallelepiped portion serves to accept the post. The concept of providing a post anchor wherein a post is mounted by means of a telescopic fitting between the post bottom and a mating configuration on the top of an anchor adapted to be driven into the ground will be found in U.S. Pat. Nos. 1,824,578 and 3,355,998 issued to Thake and Roemisch, respectively. U.S. Pat. No. 4,588,157 to Mills suggests a post holder having a top socket section provided with interlocking elements but the ground engaging portion comprises a single spike element, suggestive of am inverted pyramid and which functions in a manner totally dissimilar to that as proposed herein. It is generally known to offer supplemental stabilizing or securing means on a post anchor and which comprises fingers or the like which are displaced outwardly into the subsoil. U.S. Pat. No. 2,580,948 issued to Pancake illustrates such an arrangement but wherein a plurality of separate fingers are displaced outwardly, after the anchor device is fully disposed within the soil and, by means of the separate manipulation of a tool member. U.S. Pat. No. 4,235,034 to Black teaches that it is known to provide a post anchor device having one end provided with a socket for receiving the end of a post while the other end is formed with a leg at each of the four corners. In this example, the legs are very short, hardly as long as the depth of the socket portion, such that little or no deflection of the leg points will occur and minimal anchorage effect achieved. No combination of the disclosure of the known prior art is seen to suggest the unique construction and operation of the present anchor device.

SUMMARY OF THE INVENTION

By the present invention, an improved post anchor or support is provided and which includes an upper, post-engaging section, from which depends a lower section comprising two diametrically opposed leg members having a construction which encourages an outward displacement of the lower tips thereof as the anchor is driven into the ground. This driving action is accomplished, at least in part, following the forcing of the leg tips into the ground and wherein the bottom of a post has been inserted into a socket provided in the anchor upper section. This upper section defines a configuration generally similar to that of the post bottom but encompasses a cross-sectional area slightly greater than that of the inserted post, such that a clearance area will be formed juxtaposed one or more peripheral segments of the post bottom exterior. A plurality of tangs or interlocking elements project inwardly from the walls of the upper section and into this clearance area. These elements comprise bladed members having a top edge joined to an inner, vertical edge and are formed so that when a post bottom is lowered into the anchor upper section and driven or otherwise forced downwardly, portions of the bladed members will cut into the body of the post to provide a rigid interlocking relationship. By forming the top edges of the bladed members with a downward slope it will be appreciated that two objectives are achieved. First, the post bottom will be urged away from that portion of the anchor upper section having the bladed members and into flush engagement with the opposed wall segments which in effect will serve as an anvil during the continued cutting action by the bladed members. And secondly, the resulting obtuse angle between the bladed member top and vertical walls produces a cam-like or smoother cutting action as the post bottom is lowered.

The relative ease by which the present anchor may be driven into even very hard soil is achieved through the construction of the lower section comprising a pair of diametrically opposed legs each of which defines a right-angular configuration formed by two intersecting right triangular plates with the co-joined points thereof serving as the lowest most point of the anchor assembly. This construction results in several advantages in the operation of the invention. First, the inverted triangular configuration of the legs insures that the mass thereof is greatest at their juncture with the upper section. This provides the maximum strength where it is needed and discourages bending or collapsing of the legs during the initial stages of being driven into the ground. Secondly, the progressive diminution of the cross-sectional area of the legs, from the upper section to the lower point of the legs, facilitates the driving of the anchor into the ground. Thirdly, the outward taper or inclination of the inner edge of each leg plate insures a constant outward biasing action upon the two legs as the anchor is being driven into the ground. In this manner, as each of these four leg plate inner edges slides or cams against the soil and any rocks, roots or other obstacles, the lower portion of the legs will be deflected outwardly and subsequent driving of the assembly downwardly will cause these deflected leg portions to continue in such direction, thereby resulting in a greater anchorage of the device within the ground.

Accordingly, it is an object of the present invention to provide an improved device adapted to support and retain a sign or fence post rigidly secured relative the ground.

Another object of the present invention to provide a post holder particularly adapted to receive a polygonal post within an upper section provided with locking members that out into the body of the post bottom during driving of the post and holder into the ground.

A further object of the present invention to provide a post holder having a pair of diametrically opposed legs members each defining in cross-section a right-angular configuration permitting ready driving of the holder into the ground.

A further object of the present invention is to provide a post support having dual leg elements configured to achieve an automatic outward deflection of the lower portion of the legs as the support is driven into the ground, so as to more positively secure the post/support assembly within the ground.

Still another object of the present invention is to provide a post holder having an upper portion provided with inwardly directed guide and cutting elements on selected surfaces thereof and which initially guide an inserted post bottom toward opposite, smooth walled surfaces and subsequently are driven into the body of the post bottom.

With these and other objects in view which will more readily appear as the nature of the invention is better understood, the invention resides in the novel construction, combination and arrangement of parts hereinafter more fully described and illustrated, with reference being made to the accompanying drawings.

BRIEF DESCRIPTION OF THE DRAWINGS

Similar reference characters designate corresponding parts throughout the several figures of the drawings.

DESCRIPTION OF THE PREFERRED EMBODIMENTS

Figure 1:
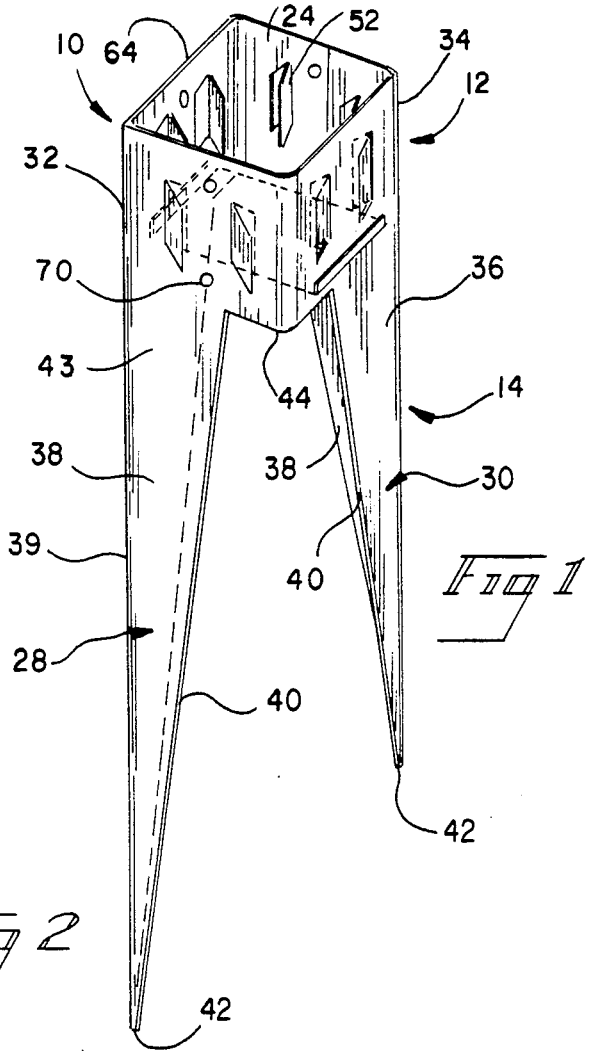
FIG. 1 is a top perspective view of one embodiment of the present invention.

Referring now to the drawings, particularly FIG. 1, the present invention will be seen to comprise an anchor device or post holder generally designated 10 and which is formed from sheet metal as a substantially unitary device having an upper section 12 from which depends a lower section 14. The upper section 12 serves as the means by which the support device is driven downwardly into the ground and also offers means by which an assembled post becomes securely interlocked therewith.

Figure 3:
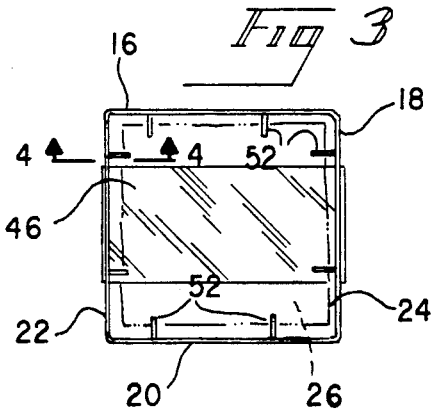
FIG. 3 is a top plan of the post holder of FIGS. 1 and 2.
Figure 5:
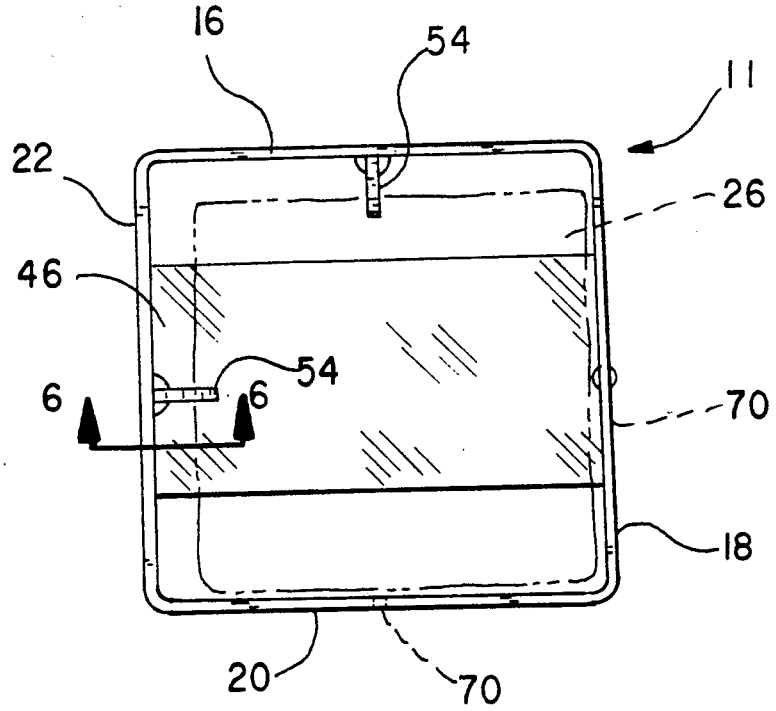
FIG. 5 is a top plan view of an alternative embodiment and illustrates, in broken lines the bottom of a post as assembled with the anchor apparatus of the invention.

As shown most clearly in FIGS. 3 and 5, the upper section 12 comprises a rectangular band including a plurality of vertical, planar side walls 16,18,20 and 22 defining a socket 24 therewithin having a polygonal and preferably, a square configuration. The cross-sectional area encompassed by this socket 24 will be understood to be slightly greater than that represented by the post bottom 26 to be assembled therewith, for reasons which will become obvious hereinafter.

The anchor lower section 14 comprises a pair of leg members 28,30 which extend downwardly from two opposite corners 32,34 of the upper section 12 with these leg members respectively formed as extensions of side walls 20,22 and 16,18. With this construction, each leg member defines a right angular configuration in cross-section, as formed by two intersecting side plates 36,38 each of which is generally of right triangular shape. Each pair of side plates 36, 38 are cojoined along straight outer edges to form an outer corner 39. From a review of FIGS. 1 and 2, it will be noted that the inclined inner edge 40 or hypotenuse of these side plates 36,38 extends from a point beyond the middle of each uppersection side wall, to a bottom point or tip 42. In this manner, the cross-sectional area or mass and therefor the strength of each leg member 28,30 will obviously progressively decrease from its widest top portion 43 adjacent the upper section bottom edge 44, toward the leg member bottom point or tip 42. This construction will have a bearing upon the operation of the post support 10 as will be explained hereafter.

The post support is adapted to be readily fabricated from stamped sheet metal which is suitably bent or folded to achieve the disclosed configuration. In this regards, the upper and lower sections may be formed from a single piece of metal stock or alternatively, these two sections may be separately formed and subsequently suitably connected, as by welding.

Figure 2:
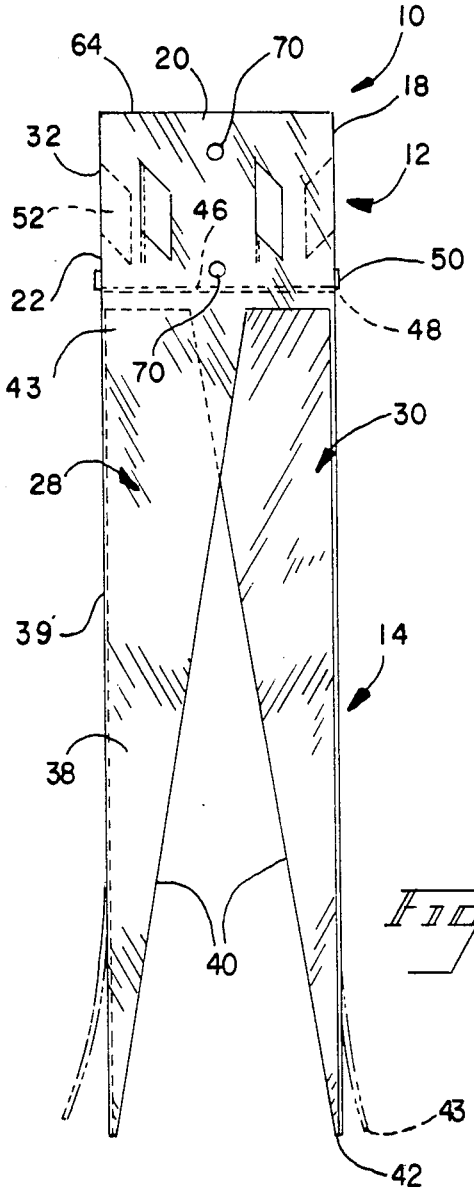
FIG. 2 is a side view elevation of the post holder of FIG. 1 with an alternate position of the lower leg portions shown in broken lines.

The bottom of the upper section socket 24 is defined by a post bottom engaging abutment plate 46 comprising a planar member spanning a substantial portion of the otherwise open bottom of the upper section 12. This plate may be secured relative the post holder in any suitable manner. In FIGS. 1–3 the plate is retained through slots 48 in the side walls 18,22 by means of the bent over flanges 50 while in FIG. 5 the opposite ends of the plate are welded to the adjacent side walls. Either manner of attachment may be employed in each of the illustrated embodiments.

Figure 4:
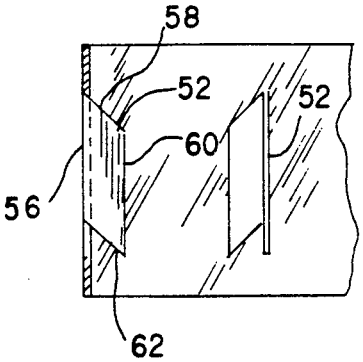
FIG. 4 is an enlarged cross-sectional view, taken along the line 4—4 of FIG. 3.

To provide an interlocking of an assembled post bottom 26 with the cooperating anchor upper section 12, a plurality of elongated tangs 52 or 54 are provided on at least certain of the side walls 16,18,20,22. The configuration of any one of these tangs in either anchor embodiment 10 or 11 is similar and each will be seen to comprise a planar bladed element disposed in a plane normal to its associated side wall and defines a parallelogram. As shown most clearly in FIGS. 4 and 6, each tang includes an outer attachment edge 56 juxtaposed a respective side wall and from which a downwardly and inwardly inclined top wall 58 projects to join with a vertical inner edge 60. The fourth side of the tang includes an inwardly and downwardly inclined bottom edge 62. The tangs may comprise a cut and punched element, struck from the material of the upper section side walls, as in the case of the tangs 52 in FIGS. 1–4 or, may comprise separate elements suitably affixed as by welding as shown by the tangs 54 in FIG. 5. Quite obviously either mode may be practiced with either post holder 10 or 11.

The use of the post holder 10 or 11 may now be described. Wooden posts as supplied for use with anchor devices are usually produced with at least a square bottom 26 with typically a 4 inch or 3½" width per side.

As previously mentioned, the area of the upper section socket 24 is slightly greater than that of the associated post bottom 26. This relationship serves two purposes. First, the sides of posts are not necessarily milled to precision and after delivery to the site of assembly may contain splinters or other deformations and secondly, the intent of the tangs is to have them become at least partially embedded within the post bottom 26 without creating a jamming action during the assembly procedure.

The post holder 10 or 11 is initially installed in the ground by placing its leg member tips 42,42 upon the top of the ground al the desired final location. Then a maul, sledge hammer or the like is used to pound the top edge 64 downward with the leg members progressively being driven into the ground. To facilitate this installation, a suitable cap (not shown) is placed over the upper section top edge 64 and the driving forces applied thereto. This will prevent deformation of the upper section side walls and at the same time permit the driving blows to be concentrated along the center vertical axis of the holder, thereby resulting in an even distribution of forces across the top edge 64. After the holder has been driven over half its height into the ground, the cap may be removed and a post installed with its bottom 26 nested within the upper section socket 24. The same aforementioned cap may be placed atop the post to prevent splitting and thereafter driving forces are applied to the post top or the cap until the upper section bottom edge is either flush with the ground or slightly below ground level.

Following insertion of the post into the socket 24, the post bottom 26 will have initially and simultaneously contacted all of the sloping top edges 68 of the tangs 52 or 64. Then, upon application of a driving force upon the top of the post, these top edges will be driven into the material of the post bottom. With the embodiment of FIGS. 1–4, the symmetrical disposition of at least one tang 52 on each side wall and the downward and inward inclination of the tang top edges 58 will provide a self-centering affect upon the post as the slicing or cutting action of the tangs takes place. The driving force is repeated until the post bottom abuts the bottom plate 46 and the leg members 28,30 are fully planted within the ground.

Notwithstanding variations in the density of the post bottom throughout its periphery, at least one-third of the radial dimension of the tangs will cut into the post bottom periphery. In the case of the post holder 10, assuming a constant post bottom density without any knots or other obstructions, the installed post will appear as in FIG. 3. With the embodiment of FIG. 5, a different action occurs during the installation procedure. When the post bottom 26 initially engages the steeply sloped top edges 58 of the two adjacent tangs 54, the inclination thereof will naturally urge the post into the direction of least resistance and since there are no tangs projecting from the two opposite adjacent side walls, the juxtaposed post surfaces will be urged into a flush engagement therewith. From this point on, driving of the post will cause the two tangs 54 to cut into the post bottom as previously described. With this latter arrangement, the two side walls not having a tang 54 act as a sliding anvil, insuring maintenance of a true vertical alignment between the post and anchor 11.

Figure 6:
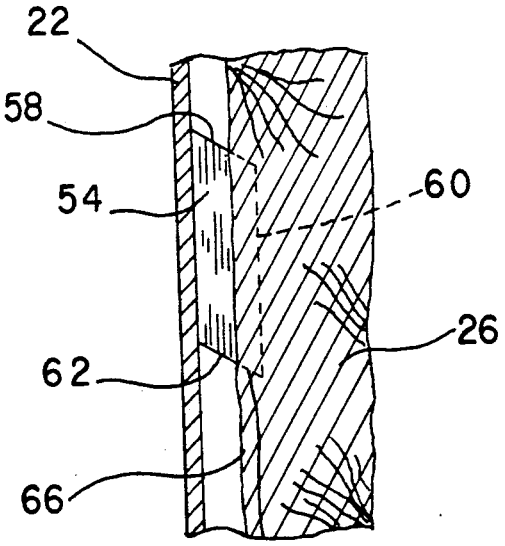
FIG. 6 is a fragmentary vertical sectional view taken along the line 6—6 of FIG. 5.

With either embodiment, the resultant assembly with the tangs embedded within the post bottom will appear as in FIG. 6. The slicing action produced by the inclined tang top edges 58 will tend to push portions of the post material in a racially inwardly direction and then, especially in the case of a green post, a certain amount of this displaced material will bounce back or expand to fill at least part of the kerf 66 having been made by each tang. This is reflected by the reduced depth of the kerf 66 and insures that the lower point 68 of the tang is captively engaged by the post material, thereby affording additional security against lifting or separation of the post from its anchor.

During the driving of the leg members 28,30 into the ground, resistance, at least during the initial stages, will be minimized due to the negligible mass or cross-sectional dimension of the leg member side plates 36,38 adjacent the leg member tips 42. The ease of installation is enhanced by the steeply inclined nature of the side pate edges 40 such that a slicing action is achieved. As any obstacles, such as stones or extremely hardened clay soil are encountered, the inclination of the inner edges 40 will urge the leg members in an outward direction and any accumulation of such resistant forces will ultimately cause the leg member tips 42 to be deflected outwardly to the position as shown at 43 in FIG. 2. With this deflection, a still greater resistance to up-rooting of the post holder is assured.

To provide for even further anchorage of a post within its assembled position, suitable fasteners such as screws or nails (not shown), may be applied through any number of holes 70 provided in one or more of the upper section side walls as shown in FIGS. 1–2 and 5.

It is to be understood that the present invention is not limited to the sole embodiments described herein, but encompasses any and all variants within the scope of the appended claims.

I claim:

1. A post supporting for engagement with the periphery of a post bottom comprising;

an upper section joined to a lower section, said upper section including a plurality of side walls defining an interior socket, said lower section including a plurality of leg members depending from said upper section side walls and terminating in bottom points substantially laterally spaced from one another, each said leg member comprising a pair of side plates having common outer edges cojoined to form a leg member corner edge, each said pair of side plates disposed normal to one another in horizontal cross-section, each said side plate disposed in a vertical plane coplanar with one said upper section side wall, each said leg member side plate comprising a planar element defining a substantially triangular configuration bounded by an inclined inner edge with each said side plate tapering from a widened top portion to a bottom point, said plurality of leg members consisting of a pair of leg member diametrically opposed to one another, at least a pair of tangs projecting into said socket and affixed to each of a plurality of said side walls, said tangs each comprising a bladed element having a top edge inclined downwardly from one said side wall adapted to cut into a post bottom periphery as a post bottom is driven into said socket, and a horizontal bottom plate spanning said socket intermediate said tangs and said lower section, whereby upon driving of a post into said socket said tangs cut into the post bottom periphery and continued driving of the post downwardly urges the post bottom to abut said bottom plate and said leg members to be driven into the ground to securely mount the post relative the ground.

2. A post support according to claim 1 wherein, said socket defines a polygonal configuration.

3. A post support according to claim 1 wherein, said upper section side walls are joined to one another to provide corners, and each said leg member corner edge comprising an axial extension of one said upper section corner.

4. A post support according to claim 1 wherein, said pair of tangs are affixed to adjacent ones of said plurality of side walls with remaining ones of said side walls being devoid of said tangs.

5. A post support according to claim 1 including, a plurality of said tangs on each of said plurality of side walls.

6. A post support according to claim 1 wherein, said tangs comprise material struck from respective ones of said side walls.

7. A post support according to claim 1 wherein, said tangs comprise separate elements, and means securing said tangs to said side walls.

8. A post support according to claim 1 wherein, said leg members are no less than three times as long as the height of said upper section, and said leg member bottom points displaceable in an outward direction as said leg member are driven into the ground.

9. A post support according to claim 1 wherein, said tangs are disposed normal to respective ones of said side walls, and said tangs having a substantially vertical inner edge.

10. A post support according to claim 2 wherein, said polygonal configuration comprises a square.

11. A post support according to claim 10 including, a bottom edge on each said tang inclined downwardly from respective ones of said side walls to said vertical inner edge.

* * * * *